United States Patent [19]

Markowski et al.

[11] 3,937,008

[45] Feb. 10, 1976

[54] LOW EMISSION COMBUSTION CHAMBER

[75] Inventors: Stanley J. Markowski; Richard S. Reilly, both of East Hartford, Conn.

[73] Assignee: United Technologies Corporation, Hartford, Conn.

[22] Filed: Dec. 18, 1974

[21] Appl. No.: 534,018

[52] U.S. Cl. ..... 60/39.06; 60/39.65; 60/39.66; 60/39.71; 60/39.74 R; 60/DIG. 11

[51] Int. Cl.[2] ..... F02C 3/24; F02M 23/00; F02M 31/00

[58] Field of Search..... 60/39.65, 39.66, 39.71, 60/39.74 R, DIG. 11, 39.06; 431/351, 352

[56] References Cited

UNITED STATES PATENTS

| | | | |
|---|---|---|---|
| 3,788,065 | 1/1974 | Markowski | 60/39.74 R |
| 3,792,581 | 2/1974 | Handa | 60/39.65 |
| 3,872,664 | 3/1975 | Lohmann et al. | 60/39.65 |

*Primary Examiner*—C. J. Husar
*Assistant Examiner*—Robert E. Garrett
*Attorney, Agent, or Firm*—Vernon F. Hauschild

[57] ABSTRACT

A low emission combustion chamber in which vitiated products of combustion from a pilot burner are caused to swirl about the combustion chamber axis before fuel droplets are introduced into the vitiated, swirling combustion products for flash vaporization therein to produce a vaporized, swirling, vitiated fuel-air mixture so as to effect ignition lag until swirling combustion air can be mixed with the swirling mixture to molecularly premix the fuel and air and increase its oxygen content to reduce the ignition lag to effect autoignition at an equivalence ratio less than 1 so as to effect high-rate, lean burning in the primary combustion chamber.

25 Claims, 16 Drawing Figures

LOW EMISSION COMBUSTION CHAMBER

CROSS-REFERENCE TO RELATED APPLICATIONS

Some of the subject matter disclosed or discussed in this application is also disclosed or discussed in applications entitled "Low Emission Combustion Chamber" and "Combustion Chamber" filed on even date herewith in the names of S. J. Markowski and J. Nolan, and R. A. Jeroszko, respectively.

BACKGROUND OF THE INVENTION

1. Field of the Invention

This invention relates to combustion chambers and more particularly to swirl type combustion chambers which produce low emission combustion both by subjecting the air passing through the engine to NOx producing elevated temperatures for minimal periods of time and by establishing a controlled ignition lag so as to permit molecular premixing between a vitiated, swirling, prevaporized fuel-air mixture and swirling primary combustion air to establish controlled autoignition so as to produce high-rate, lean burning in the primary combustion chamber.

2. Description of the Prior Art

In the combustion art, swirl burning has been used both to accelerate mixing and combustion of fuel and air to accelerate mixing of products of combustion and cooling air during the dilution process, as in Markowski U.S. Pat. Nos. 3,701,255; 3,747,345; 3,788,065; 3,792,582; and 3,811,277, Lewis U.S. Pat. No. 3,675,419 and pending U.S. patent application Ser. No. 406,711 filed Oct. 15, 1973 in the names of S. J. Markowski and R. H. Lohmann and entitled "A Swirl Combustor With Vortex Burning and Mixing", but these prior art swirl burners do not use selective swirl burning to effect low emission combustion in the manner described herein.

SUMMARY OF THE INVENTION

A primary object of the present invention is to provide the method and hardware for producing low emission in a combustion chamber both by reducing the dwell time of engine gases at elevated NOx producing temperature and by establishing a sufficient ignition lag to permit molecular premixing of swirling, vitiated, vaporized fuel-air mixture from a pilot combustion chamber with swirling combustion air entering the main combustion chamber so that auto-ignition therebetween occurs at an equivalence ratio less than unity and so that high-rate, lean and low emission burning occurs in the main combustion chamber. As used herein the terms equivalence ratio is the ratio of a fuel-air mixture to a stoichiometric fuel-air mixture, and will hereinafter be referred to as ER. As used herein, the term "vitiated" is used in describing a fuel and air mixture, where the oxygen available for combustion in the air or mixture is less than the normal 21%, that is, a mixture of reduced oxygen content.

In accordance with the present invention, the ignition lag established is in the order of one or possibly two milliseconds.

In accordance with a further aspect of the present invention, fuel droplet burning is avoided because of the high relative velocity between the fuel droplets and the surrounding gas, because of the vitiated condition of the gas mixing with the fuel droplets, and because of the centrifugal force generated in the swirling gases to strip peripheral vapor from the droplets before combustion occurs.

It is a further aspect of the present invention to teach process and hardware for producing low emission combustion using the principle of minimal dwell time at elevated temperatures and molecular premixing of the fuel-air by a rapid diffusion mixing process in conjunction with a controlled ignition lag.

It is a further teaching of this invention that the pilot combustion chamber comprise a radially extending forward wall through which axially extending fuel nozzles project, while enveloped by swirl vane rings, and wherein a corrugated and canted trigger mechanism is used to impart swirl to the vitiated products of combustion from the pilot combustion zone, preferably with the simultaneous addition of swirling air thereto, wherein fuel droplets are injected into the vitiated, swirling products of the pilot combustion chamber so as to rapidly vaporize the fuel to produce a swirling, vitiated, vaporized fuel-rich air mixture to which swirling air is added upon entry to the primary combustion chamber, preferably from a downstream corrugated and canted trigger mechanism, to effect molecular premixing of the vaporized fuel and air to bring about controlled autoignition with attendant high-rate, lean burning to produce low exhaust emissions.

It is still a further aspect of the present invention to teach such a combustion chamber in which the molecular premixing of fuel and air is aided by a controlled ignition lag accomplished by injecting fuel droplets into a vitiated products of combustion to flash vaporize the fuel before further air is added thereto to bring about autoignition at an ER less than 1.

It is still a further teaching of the present invention to promote mixing and rapid combustion in the primary combustion chamber by introducing swirling air thereto by means of a corrugated and canted trigger and to also use plunged holes in the outer wall of the combustion chamber liner at that station to produce cooperating combustion air streams for mixing with the swirling air flow.

It is still a further feature of the present invention to teach such a combustion chamber in which axially staged corrugated triggers are utilized so as to prevent the stalling of the downstream trigger which would occur if it were required to impart too much swirl to the mixture, and wherein the convolutions of each trigger are canted at about a 55 degree angle to the axis of the combustion chamber so as to produce typically 30 degree swirl in the primary combustion chamber.

It is still a further aspect of the present invention to teach such a combustion chamber in which the products of combustion from the primary combustion chamber are rapidly diluted so as to reduce their temperature below the emission creating level with minimal dwell time thereabove.

It is still a further aspect of the present invention to teach such a combustion chamber which is of minimal axial dimension and in which ignition takes place completely in a matter of milliseconds.

It is a further aspect of this invention to teach such a combustion chamber wherein low emission combustion occurs by introducing swirling combustion air to a vaporized, fuel rich-air mixture to produce molecular premixing of the fuel and air and to establish an ignition lag to thereby produce autoignition at an ER less than 1.

It is a further aspect of this invention to teach such a combustion chamber which vaporizes the fuel.

Other objects and advantages of the present invention will be evident by referring to the following description and claims, read in conjunction with the accompanying drawings.

DESCRIPTION OF THE PREFERRED EMBODIMENT

Figure 1:
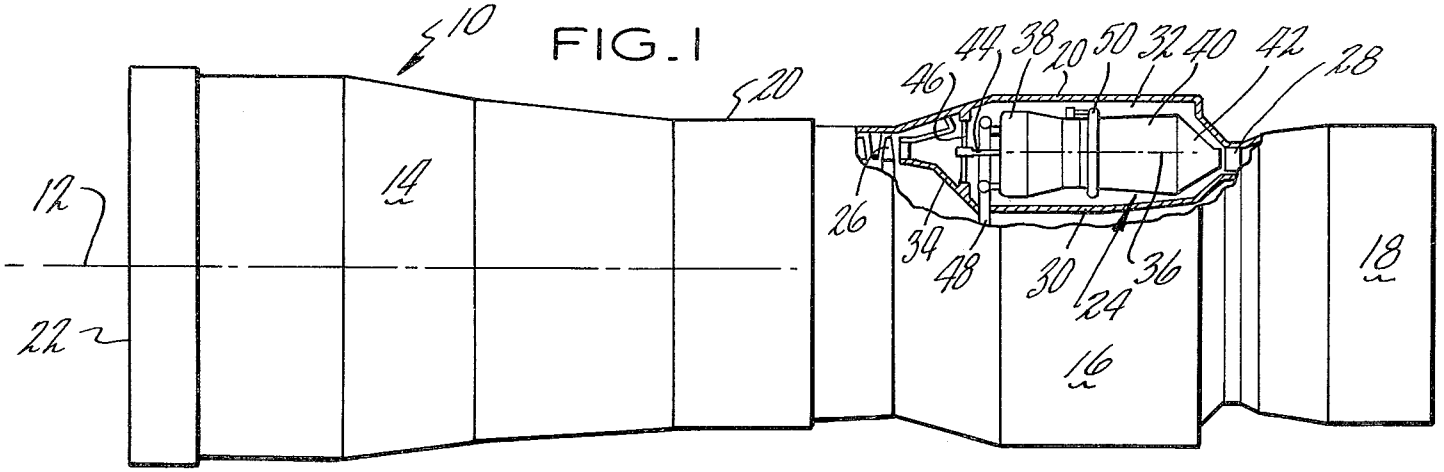
FIG. 1 is a side view of a gas turbine engine, partially broken away to show the combustion chamber in its environment.

Referring to FIG. 1 we see a gas turbine engine 10 utilizing the combustion chamber of interest. Gas turbine engine 10 is preferably of circular cross section and concentric about engine axis 12 and comprises a conventional compressor section 14, burner section 16 and turbine section 18, all enveloped within engine case 20 so that air entering engine inlet 22 is compressed in passing through compressor section 14, has energy added thereto in passing through burner section 16, and has energy extracted therefrom sufficient to drive compressor 14 when passing through turbine section 18. The air from turbine 18 may be either discharged through a conventional exhaust nozzle to generate thrust or may drive a free turbine to generate power. Combustion chamber 16 may consist of a plurality of can-type burners 24 positioned in circumferential orientation about axis 12 and located axially between the last compressor stage 26 and the forward turbine stage 28. Each can burner 24 is positioned radially between engine case 20 and inner case 30, so that each burner 24 is located in annular passage 32, which connects the compressor to the turbine. The air leaving the compressor last stage 26 passes through diffuser section 34 and then either through or around combustion chambers 24 to turbine first stage 28. The air which passes around the combustion chamber is primarily cooling air and the air which enters the combustion chamber is either used to support combustion or to dilute the products of combustion so as to reduce their temperature sufficiently to permit them to pass through turbine stage 28 without damaging the turbine. Burner 24 is perferably can shaped and concentric about burner axis 36 and includes pilot combustion zone 38, main combustion zone 40 and transition sections 42, which join the circular afterends of each burner can to the turbine first stage 28 as transition section 42 changes in cross-sectional area from a mating circle to the burner can at its forward end to match the arcuate shape of turbine stage 28 at its after end. Burners or combustion chambers 24 are supported by support members 44, which are pivotally connected to support rod 46 so as to retain burner 24 in its desired axial position. Pilot fuel passes through pilot fuel manifold 48 and into the combustion chamber in a manner to be described hereinafter, while the primary fuel passes through manifold 50 then into the combustion chamber in a manner to be described hereinafter.

While burner 24 is shown and described as one of a series of cans positioned circumferentially about the engine axis, it could as well be a single annular burner joining compressor 14 to turbine 18.

To appreciate the specific construction of combustion chamber 24, it seems advisable to first consider its principles of operation to effect low emission combustion. These may be better understood by considering FIGS. 2 and 3.

Figure 2:
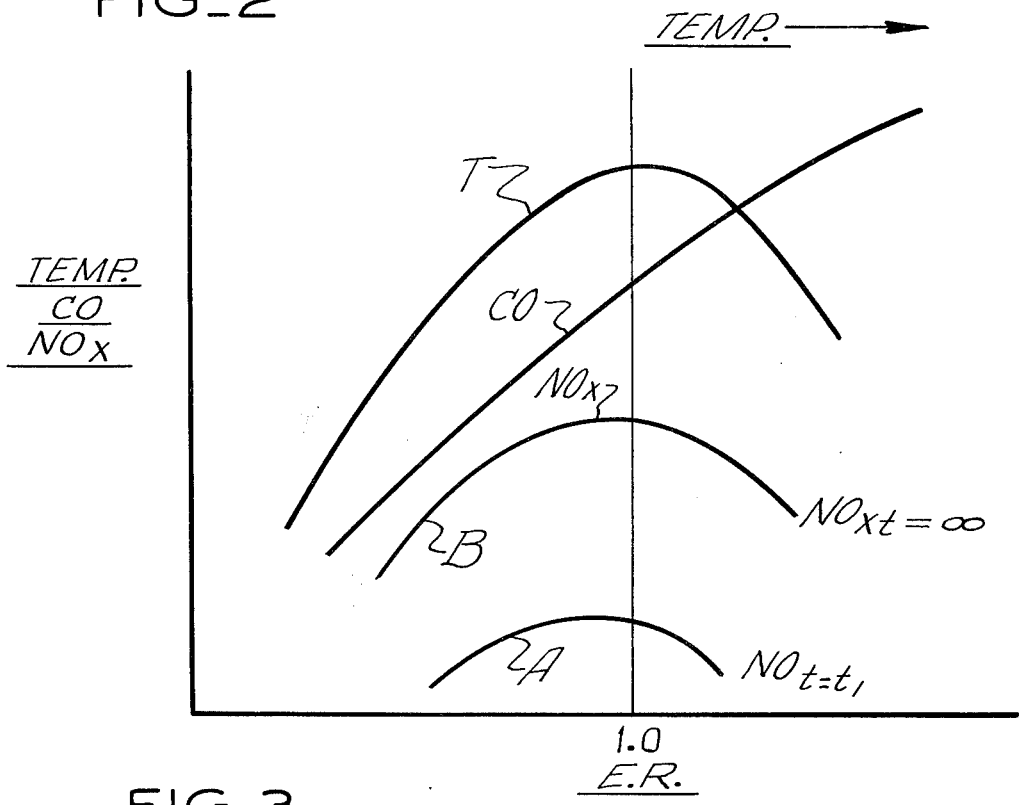
FIG. 2 is a graph demonstrating the emission benefits to be gained by minimizing the dwell time of the engine gases at elevated temperatures.

FIG. 2 shows a graph with the combustion chamber ER as one coordinate with an ER of 1.0 being a stoichiometric mixture. In the FIG. 2 graphs, the stoichiometric mixture with ER of 1.0 is indicated and it will be realized that ER less than unity (lean fuel-air mixtures) are to the left thereof while ER greater than unity (rich fuel-air mixtures) are to the right thereof. The other coordinate of the FIG. 2 graph represents temperature of combustion T, the carbon monoxide (CO) formed by combustion, and the oxides of nitrogen (NOx) formed in an engine. Viewing the FIG. 2 graph, it will be noted that temperature of combustion is maximum at the ER of slightly greater than 1, that the carbon monoxide (CO) generated by combustion increases with ER, and that the dwell time of the engine gases at elevated temperatures causes an increase in the amount of NOx generated. The latter is best demonstrated by comparing curve A, which represents NOx generated by subjecting the engine gases to elevated temperatures for a finite time, and graph B, which represents NOx generated by subjecting engine gases to elevated temperatures for an infinite time. It is a known fact that the amount of NOx generated by heating air is a function of the time for which the air is held at the necessary elevated temperature, whether or not there is combustion involved, and this is actually the principle demonstrated by curves A and B of FIG. 2. By viewing FIG. 2, it will accordingly be seen that minimal NOx will occur if we subject the engine gases, including the air therein, to NOx creating temperatures for a minimal time period. The carrying out of this principle is one of the functions of operation of this combustion chamber. It is generally accepted that objectionable NOx production is generated by elevating air or engine gases to temperatures above 3200°F.

Figure 3:
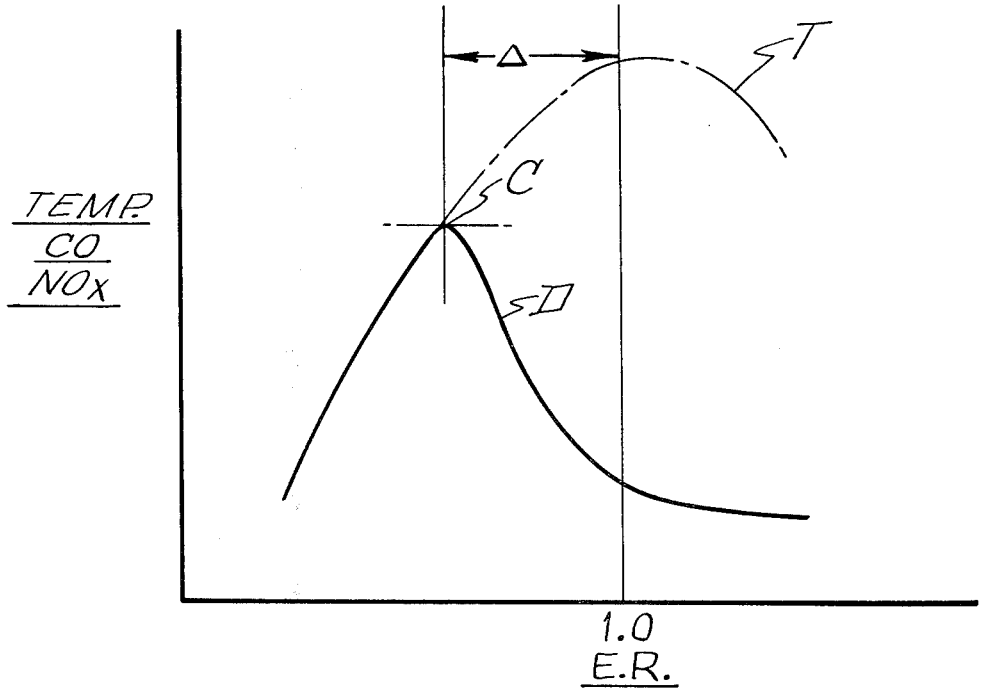
FIG. 3 is a graph demonstrating the emission benefits to be gained by establishing an ignition lag so that molecular premixing of fuel and air can be accomplished to an ER of less than 1 prior to autoignition and subsequent combustion.

Referring to FIG. 3 we see a graph of the same coordinates and which illustrates the reduced temperature, carbon monoxide generation and NOx creation which can be achieved by controlling autoignition and causing combustion to occur through an ignition lag at a reduced ER. Viewing FIG. 3 we see the conventional temperature curves T which occurs with ER variation above and below unity, i.e., stoichiometric. It will be noted therefrom that if we can cause autoignition and combustion to occur at a reduced ER, such as at point C, we have accomplished reduced combustion temperature, CO formation by combustion, and NOx generation. Curve D represents, schematically, the locus of ER states transversed by a characteristic unit of fuel during mixing with swirling combustion air in the primary zone prior to autoignition. Δ represents the characteristic lean ER displacement from stoichiometric (ER = 1.0) achieved by the premixing within the autoignition lag time period. FIG. 3 demonstrates the second principle of combustion operation utilized in this combustion chamber, namely molecular premixing of the fuel and air permitted by an ignition lag to produce autoignition at a reduced ER.

Figure 16:
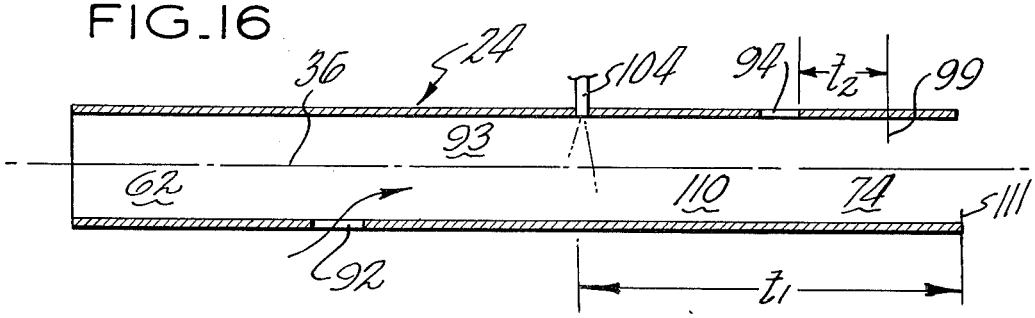
FIG. 16 is a schematic representation of a combustion chamber utilizing this invention.

The operation of this combustion chamber may be better understood by also viewing FIG. 16 which is a schematic representation of combustion chamber operation following our teachings.

It should be borne in mind that autoignition in a fuel-air mixture is brought about by a combination of oxygen content, temperature above vaporization temperature and ER of the mixture, and time. For a given oxygen content in a fuel-air mixture, and assuming that the temperature thereof is above the fuel vaporization temperature, if we allow any such mixture to remain at this condition for sufficiently long time, it will autoignite. We are taking advantage of this characteristic of a fuel-air mixture to first establish an ignition delay at the time we inject the fuel droplets so that the fuel will vaporize rather than burn as droplets. This by way of fuel preparation. Thereafter, we introduce swirling combustion air to effect molecular mixing between the fuel and air due to the swirling quality of the two streams and raise the oxygen level of the new mixture so that autoignition occurs sooner than would have been the case had we not introduced the swirling combustion air, and at an ER less than 1. It will be seen that we establish and control ignition lag to obtain these emission benefits.

Viewing FIG. 16, initial combustion takes place in pilot combustion zone 62 wherein hot, fully combusted, pilot exhaust gases of reduced oxygen content are generated and discharged downstream therefrom. Swirling, cool air is then introduced through swirler 92 to the pilot exhaust gases to produce a first mixture in zone 93 formed of the pilot exhaust gases and this swirling air from 92, which first mixture will be swirling about axis 36 and will have a lower temperature than the pilot exhaust gases but a sufficiently high temperature to vaporize the fuel to be injected at a station downstream in this combustion chamber. This first swirling mixture will also be of reduced oxygen content, i.e. vitiated, because the selected amount of swirling air introduced through swirler 92 does not replace all of the oxygen burned in the pilot zone 62. We then introduce atomized fuel from atomizer or atomizers 104 to produce a second swirling mixture in zone 110 of reduced oxygen content so as to prevent or delay autoignition of the fuel droplets so injected but, rather, cause the fuel droplets to vaporize fully due to the temperature of the second swirling mixture. The second mixture also swirls about axis 36 and is a vaporized, swirling fuel-air mixture having an oxygen content which will produce autoignition of the second swirling mixture at time delay (ignition lag) $t_1$. It is important to note that if the combustion chamber of FIG. 16 did not include the additional structure or features to be described hereinafter, autoignition of this second swirling mixture would occur at station 111 after this first time delay $t_1$ had elasped. This time delay $t_1$ is not permitted to run full term, however, in our combustion chamber.

Swirling combustion air is introduced through swirler 94 to produce a third mixture in zone 74 swirling about axis 36 and consisting of the swirling second mixture and the swirling combustion air from swirler 94 which produces molecular mixing between the fuel and air due to the fact that both of these fluids are swirling, this third swirling mixture has an oxygen content greater than that of said second swirling mixture to establish a new and reduced ignition lag or delay time $t_2$ in the third mixture to thereby cause autoignition of the third swirling mixture at station 99 in chamber 74 at an ER less than 1 when delay time $t_2$ has expired. It should be noted that introducing swirling air at swirler 94, autoignition of the third mixture has occurred upstream at station 99 and earlier in time than autoignition of the second mixture which would have occurred at station 111. The benefit of this earlier combustion, and the subsequent dilution of the products of combustion thereof, is to reduce the dwell time of the engine air at the NOx creating temperature and thereby further reduce exhaust emissions.

Figure 6:
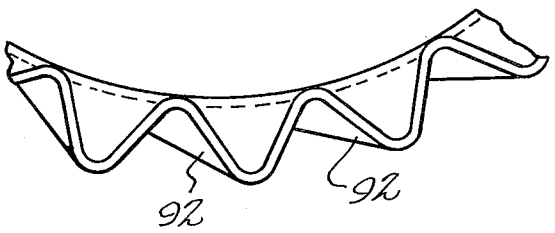
FIG. 6 is a view taken along line 6—6 of FIG. 4.
Figure 4:
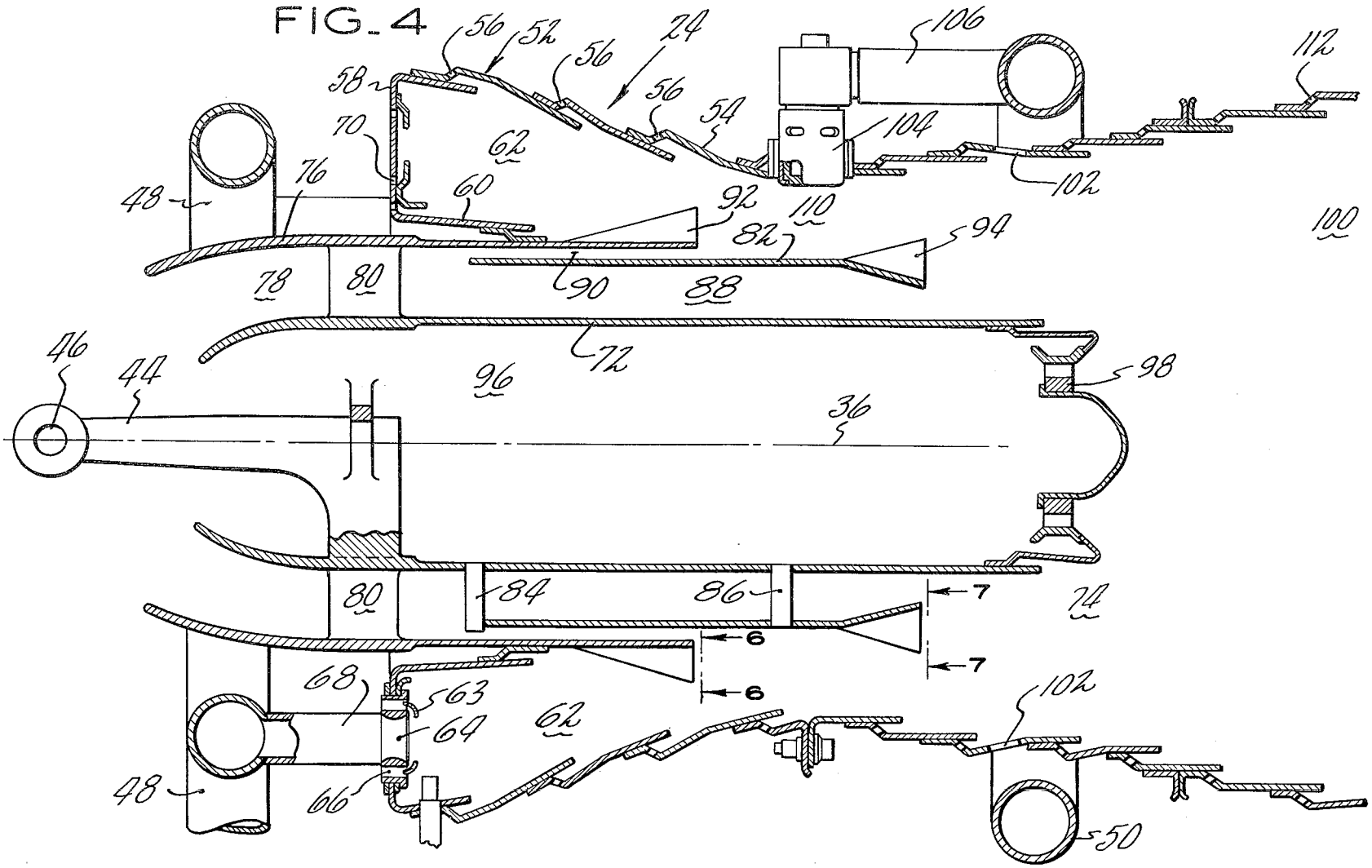
FIG. 4 is a cross-sectional showing of the combustion chamber.
Figure 5:
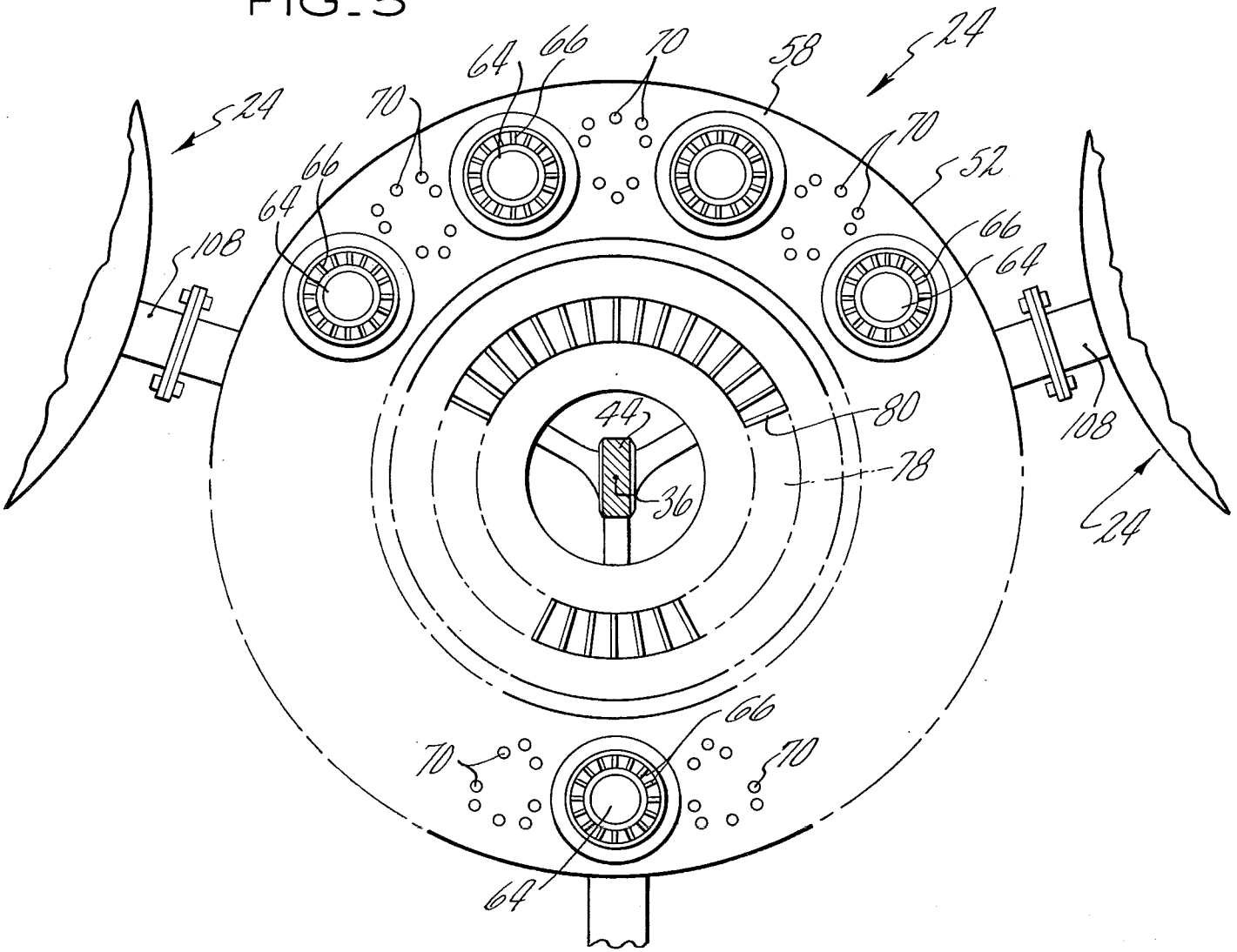
FIG. 5 is a front view of the combustion chamber.

Referring to FIGS. 4 and 5 we see combustion chamber 24 in greater particularity. Reference numerals used in explaining FIG. 6 will be used to identify common parts in FIGS. 4 and 5. As previously mentioned, combustion chamber 24 is shown to be of the can type and concentric about axis 36, but it should be borne in mind that it could well be a single annular combustion chamber extending between compressor 14 and turbine 18 of FIG. 1 and concentric about axis 12. Combustion chamber 24 consists of an outer louver wall 52 comprising a plurality of overlapping and joined louver rings 54 having a plurality of cooling air apertures 56 at the forward end thereof to permit the cooling of wall 52. Outer wall 52 is joined to forward wall 58, which is substantially flat and extends radially, and which is joined to inner wall 60 so as to form annular pilot combustion chamber 62 therewithin. A plurality of fuel nozzles 64 are circumferentially spaced around forward wall 58 and extend axially therethrough and are enveloped by conventional swirl vane rings 66, through which pilot primary combustion air passes in conventional fashion to establish a stagnation zone downstream of each fuel nozzle 64 to support combustion in pilot combustion chamber 62. Fuel is directed to nozzle 64 from pilot fuel manifold 48, which joins to each nozzle through a conduit such as 68. A plurality of cooling air holes 70 are positioned in forward wall 58.

Figure 7:
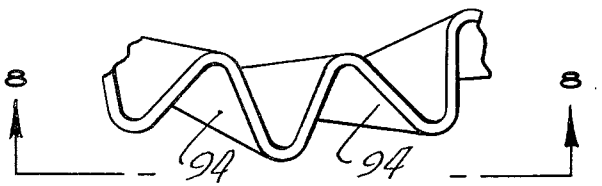
FIG. 7 is a view taken along line 7—7 of FIG. 4.
Figure 8:
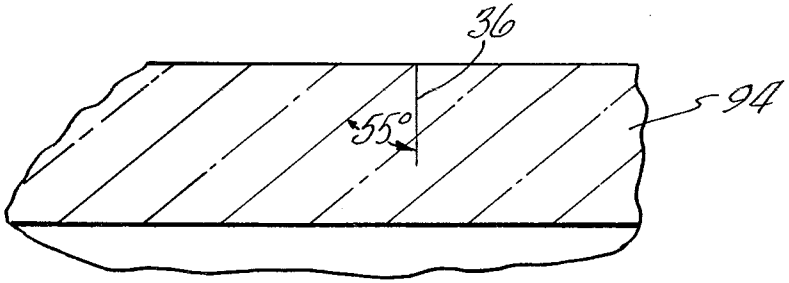
FIG. 8 is a view taken along line 8—8 of FIG. 7.

Inner body 72 is positioned concentrically about axis 36 within outer wall 52 and cooperates therewith to define annular primary combustion chamber 74, which increases in cross-sectional area in a downstream direction so as to serve as a diffuser. Sleeve member 76 concentrically envelops central member 72 to define annular combustion air passage 78 therebetween. A plurality of swirl vanes 80 are located circumferentially within annular combustion air passage 78 and are of selected angularity, such as 55 degrees, to impart swirl about axis 36 to the combustion air passing therethrough. Duct member 82 is concentrically positioned between members 72 and 76 and may be supported from member 72 by pin member 84 and 86 to cooperate therewith to define annular combustion air passage 88 with inner body 72 and annular combustion air passage 90 with member 76. Trigger members 92 and 94 are supported from the downstream ends of members 76 and 82 so as to constitute axially staged triggering of the combustion air passing through combustion air passage 78 and then dividing into passage 88 and 90. Trigger mechanisms 92 and 94 are preferably corrugated rings, whose corrugations cant or are angular with respect to axis 36 and which serve to impart a rotational or swirling motion about axis 36 to the air passing thereunder and to the products of combustion passing thereover. By viewing FIGS. 6, 7 and 8 it will be seen that trigger mechanisms 92 and 94 are corrugated ring members, whose corrugations have maximum amplitude at their downstream ends and minimum amplitude at their upstream ends and whose corrugations, as best shown in FIG. 8 form an angle of about 55 degrees with the combustion chamber axis 36.

Cooling air passes through the interior cylindrical passage 96 within inner body 72 and then through swirl vane ring 98 into combustion chamber dilution zone 100.

Outer wall or liner 52 includes a plurality of radially extending and circumferentially oriented holes 102 extending therethrough, through which air may flow into the interior of the combustion chamber and into the main combustion stream 74 in barberpole fashion to accelerate mixing within combustion chamber 74 as more fully described in U.S. Pat. No. 3,788,065. Fuel for the primary combustion chamber 74 enters through manifold 50 and is injected in droplet or atomized form through a plurality of fuel nozzles 104, which are positioned circumferentially selectively about outer wall 52 and each joined to manifold 50 through a conduit member 106.

Conventional cross-overtubes 108 extend between adjacent combustion chamber 24 for conventional purposes.

OPERATION

Viewing FIGS. 4 and 5, the operation of combustion chamber 24 will now be described. Fuel enters pilot combustion chamber 62 in atomized, spray form through a plurality of conventional fuel nozzles 64 which are positioned circumferentially about the radial forward wall 58 of combustion chamber 24. In conventional fashion, each fuel nozzle 64 is enveloped by a swirl vane ring 66 through which a portion of the combustion chamber air passes to establish a recirculation zone to support combustion in pilot combustion chamber 62. If desired, toroidal deflector ring 63 may be used to intercept some of the air from swirl vane ring 66 and direct it across the exposed face of nozzle 64 to prevent coke formation thereon. The products of combustion from pilot combustion zone 64, which typically have an ER of about 0.35 and a temperature of about 2000°F then flow in fully combusted, vitiated fashion and at elevated temperature rearwardly over the outer surfaces of the canted convolutions of trigger ring 92 to have swirl about axis 36 imparted thereto in passing thereover. At the same time, combustion or cooling air from passage 90 is introduced to the pilot products of combustion in swirling fashion as the air passes over the inner, canted convolutions of trigger mechanism 92 and its swirling momentum, which it gains by passing over swirl vanes 80 and trigger 92, adds to the swirling component of the pilot products of combustion and accelerates rapid mixing between the pilot products of combustion and the swirling air from trigger 92. In typical swirl mixing fashion, the product parameter $\rho V_t^2$, where $\rho$ is density and $V_t$ is tangential velocity, for the air from trigger 92 will be greater than the comparable product parameter of the pilot products of combustion so that intermixing therebetween is accelerated as fully explained in U.S. Pat. No. 3,788,065. In this fashion, a vitiated, gas mixture is introduced in swirling fashion to chamber region 110 at a temperature below the NOx generating temperature but at a sufficiently high temperature that it is capable of vaporizing fuel droplets. Typically the mixture of pilot products of combustion and trigger 92 air entering region 110 will have an ER of about 0.18 and a temperature of about 1500°F. Atomized fuel droplets are then directed into this vitiated, swirling mixture at station 110 from a plurality of circumferentially positioned fuel nozzles 104 for flash vaporization therewith. Flash vaporization occurs and droplet burning is avoided at station 110 because of the high relative velocity between the fuel droplets and the surrounding swirling gas, because of the vitiated condition of the swirling gas, and because centrifugal force of the swirling gas strips the peripheral vapor from the droplets before combustion can occur. In this fashion, a swirling, vitiated, vaporized fuel rich-air mixture is created having an ignition lag or delay time $t_1$ as described supra and is passed over the outer surfaces of the convolutions of trigger mechanism 94 to have further swirl imparted thereto and for immediate mixing with the swirling combustion air from passage 88, which has swirl imparted thereto both by passing swirl vanes 80 and the inner surfaces of the canted convolutions of trigger 94. Mixing of the fuel and air in the primary combustion zone 74 is aided by the fact that combustion air also enters a plurality of circumferentially disposed ports 102 in burner wall 52 and is directed substantially radially inwardly therefrom as discrete streams of combustion air moving substantially radially in barberpole fashion toward the outwardly directed convolutions of combustion air from passage 88 passing under trigger 94 and cooperating therewith to effect rapid mixing and combustion between the fuel and air utilizing both the swirl burn principle and the barberpole mixing principle described more fully in U.S. Pat. No. 3,788,065. Typically the ER of the vaporized, fuel richair mixture will be above 1 before mixing with combustion air from trigger 94 and below 1 thereafter. The product parameter $\rho V_t^2$ dissimilarity between the vitiated, vaporized fuel-air mixture and the passage 88 combustion air causes accelerated mixing therebetween so that the fuel and air are molecularly premixed and the ER reduced to below unity before autoignition occurs in primary combustion zone 74 as the addition of oxygen from the air from passage 88 to the vitiated, vaporized fuel brings the oxygen content of the mixture to a level to reduce the ignition lag to $t_2$ as described in connection with FIG. 16 to effect auto-ignition at point C shown in FIG. 3. It will therefore be seen that the introduction of combustion air at 94 both reduces the ER of the fuel air mixture below 1 and raises the oxygen content to accelerate autoignition thereof. It will be observed that an ignition lag has occurred from the time atomized fuel is injected from nozzles 104 until it is finally autoignited in primary combustion chamber 74, thereby giving the fuel and air the opportunity to molecularly premix and avoid fuel droplet burning to produce high-rate, lean burning in the primary combustion zone 74 so that minimum NOx is generated. As best shown in FIG. 3, since autoignition has taken place at point C, the temperature of combustion, the amount of CO generated by combustion, and the amount of NOx generated by exposure of the exhaust gases to elevated temperatures is reduced over that which would have occurred by combustion of fuel droplets at ER unity. Due to the high velocity of the gases passing through combustion chamber 24, which is in the vicinity of 400 feet per second, the ignition will probably occur in combustion zone 74 at ER of about 0.45 temperature of about 2500°F.

It is important to note that this combustion chamber does not utilize fuel droplet burning, but rather prevaporizes the fuel for molecular mixing with the combustion air for high-rate, lean burning to produce minimum NOx. In fuel droplet burning, the periphery of the droplet is brought to elevated temperatures as soon as burning commences and the air in that vicinity is raised above the NOx creating temperature. As burning continues, all of the fuel combusted with the air in the combustion area goes through the maximum achievable temperatures at ER slightly greater than 1.0, thereby generating a substantial amount of NOx because fuel droplet burning has caused the air in the burner to be subjected to NOx creating temperature for long periods of time.

Dilution air passes through passage 96 and through swirl vane ring 98 to mix with the products of combustion from combustion zone 74 and to rapidly reduce their temperature below a temperature which would be injurious to turbine 28. The desired dissimilar product parameter $\rho V_t^2$ preferably exists between the dilution air from swirler 98 and the products of combustion from primary combustion chamber 74 to accelerate mixing and hence dilution and cooling therebetween. Additional cooling air is received through passages in wall 52, such as passages 112, and any other apertures of conventional design in the louver rings 54 located axially downstream of zone 74.

It is also important to note that due to the rapid mixing of fuel and air and the rapid combustion in this combustion chamber, all combustion occurs in a very short axial dimension so that the overall dimension of the combustion chamber is minimal.

The desired low emission combustion accomplished in this combustion chamber is brought about by a combination of combustion principles, first, by subjecting the engine air to elevated temperatures for a minimal period of time to gain the low NOx benefit demonstrated in FIG. 2 and, second, by molecular premixing of fuel and air permitted by controlled ignition lag to obtain the additional low emission benefit to be gained as illustrated in FIG. 3.

It may be considered that triggers 92 and 94 constitute staged swirling, thereby avoiding the stalling in the trigger 94, which could occur if trigger 94 alone were used and thereby had to impart very high swirl components to the gas passing thereover.

From an operations standpoint, pilot burner 62 alone may be operated during engine idle operation, while both pilot burner 62 and main burner 74 are operational during higher power operations such as at takeoff.

To this point, combustion chamber 24 has been described utilizing a radially extending forward wall 58 with axially extending fuel nozzles 64 and swirl vane rings 66 extending therethrough and with swirl imparted to pilot products of combustion by trigger 92. Modifications of this construction, as shown in FIGS. 9 through 15, will now be described in which wall 58 is not always radially extending and in which the fuel nozzles and the swirl vane rings may not be axially extending.

Figure 9:
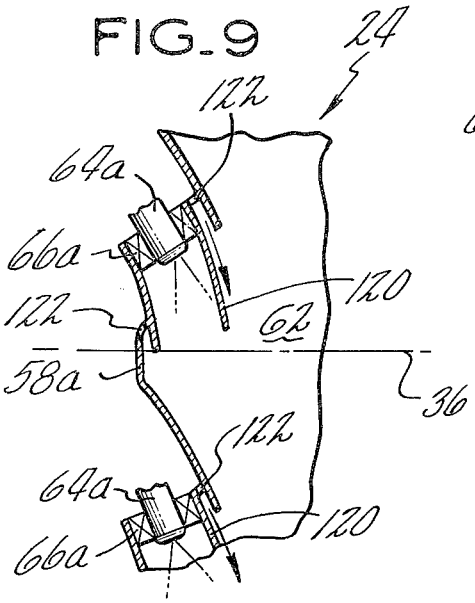
FIG. 9 is an unrolled view of a first modification of the annular pilot combustion chamber.

In the construction shown in FIG. 9, a modification of combustion chamber 24 at combustion zone 62 is shown in which the combustion chamber wall **58*a* is radially extending in part and is shaped to support a plurality of circumferentially disposed fuel nozzles 64*a* positioned within swirl vane rings 66*a* so that the fuel nozzles and swirl vane rings are angularly disposed with respect to combustion chamber centerline 36 so as to produce swirling combustion in pilot zone 62. The products of combustion from the FIG. 9 pilot combustion zone 62 will also be swirling about axis 36 as they enter secondary fuel injection zone 110. The remainder of combustion chamber 24 of the FIGS. 9-15 modifications will be as shown in FIG. 4. In is intended that with the constructions shown in FIGS. 9 through 15, upstream trigger 92 can be eliminated, but it could also be used, if desired, in the FIGS. 9 through 15 configurations. Fuel nozzles 64*a* and 66*a* of FIG. 9 are positioned in swirl flow guides 120, which may either by a cylindrical or axially curved tube of circular cross section or selectively shaped wall members oriented to direct the entry of the fuel and swirling air from nozzle 64*a* and vanes 66*a* into pilot combustion zones 62 in swirling or tangential fashion with respect to centerline 36. Cooling louvers 122 are located in the downstream walls of guides 120 and serve to introduce cooling air along the outer periphery of the downstream walls of guides 120 to protect the walls from the heat of the pilot combustion zone 62. Louvers 122 may be of any conventional design such as slots or discrete holes of the type shown in FIG. 4 as cooling air holes 56 and 112**.

Figure 10:
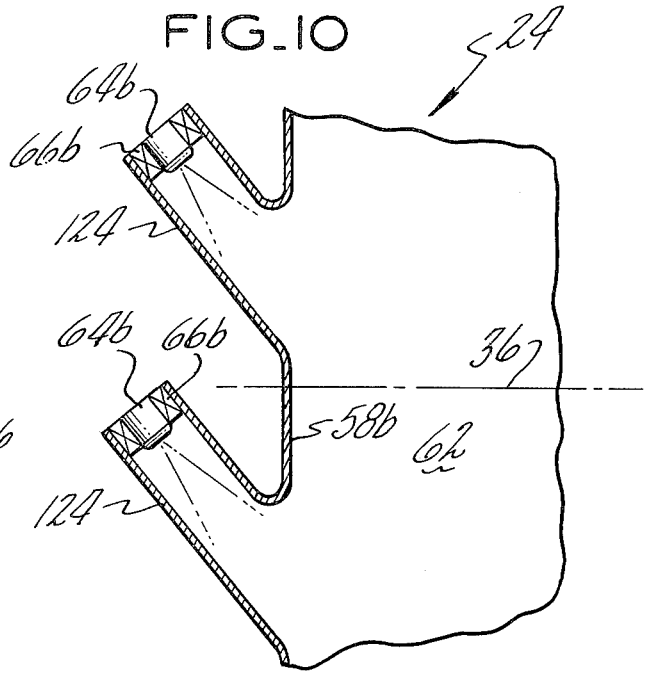
FIG. 10 is a unrolled view of a second modification of the annular pilot combustion chamber.

The FIG. 10 configuration is a second modification of the pilot zone area of the FIG. 4 combustion zone chamber wherein forward wall **58*b* of annular pilot zone 62 of combustion chamber 24 has a plurality of circumferentially disposed and spaced pipe or conduit members 124 extending upstream thereof so as to be canted with respect to combustion chamber axis 36 and so as to each support a fuel nozzle 64*b* and swirl vane ring 66*b* therewithin at the forward or upstream end thereof so that the fuel nozzle and swirl vanes are similarly canted with respect to axis 36. In the FIG. 10 construction, the fuel and air from the fuel nozzles 64*b* and rings 66*b* will enter combustion chamber 62 as a series of swirling fuel-air mixture columns whose paths are tangentially or canted with respect to axis 36 so as to establish swirling combustion within and products of combustion discharge from pilot zone 62. In all of the FIGS. 9–13 constructions, the swirl established in the pilot combustion chamber 62 is selected so as to match or optimally integrate with downstream swirler 94**.

Figure 11:
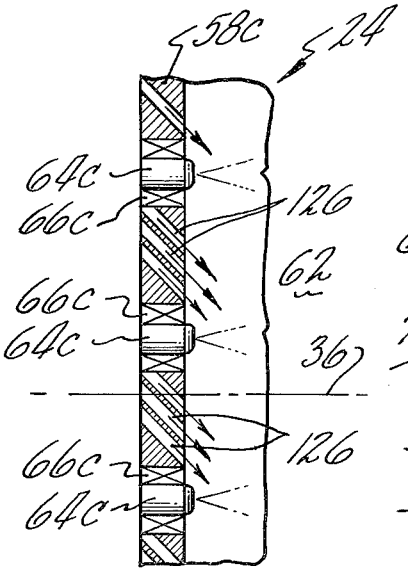
FIG. 11 is an unrolled view of a third modification of the annular pilot combustion chamber.

FIG. 11 shows a third modification of combustion chamber 24 wherein forward wall **58*c* is radially extending and supports a plurality of axially extending fuel nozzles 64*c* enveloped by swirl vane rings 66*c*** therewithin. Forward wall 58*c* has a plurality of angularly disposed, preferably parallel passages 126 extending therethrough so that the air passing through passages 126 is introduced to combustion chamber pilot zone 62 in angularly or swirling relation to axis 36 so as to intercept the fuel being injected through fuel nozzle 64*c* and impart angular flow thereto so as to establish a combustion in and discharged from zone 62 which swirls about axis 36.

Figure 12:
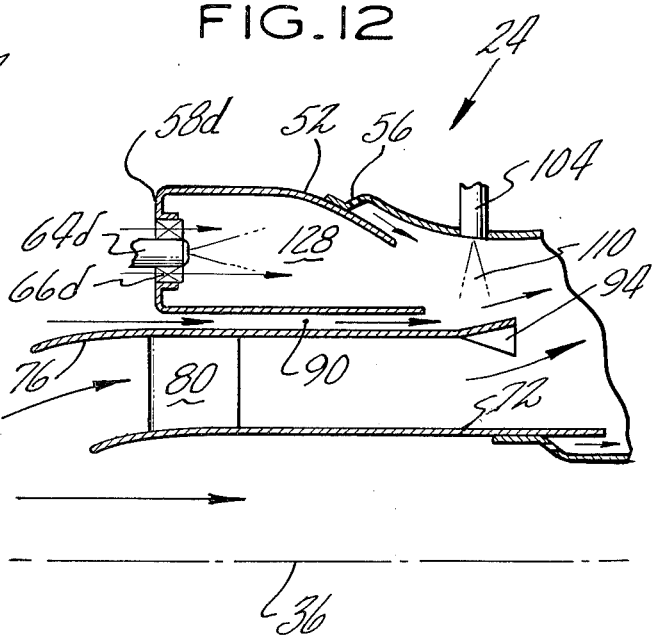
FIGS. 12 and 13 are a cross-sectional showing and an unrolled view respectively of a fourth modification of the annular pilot combustion chamber.
Figure 13:
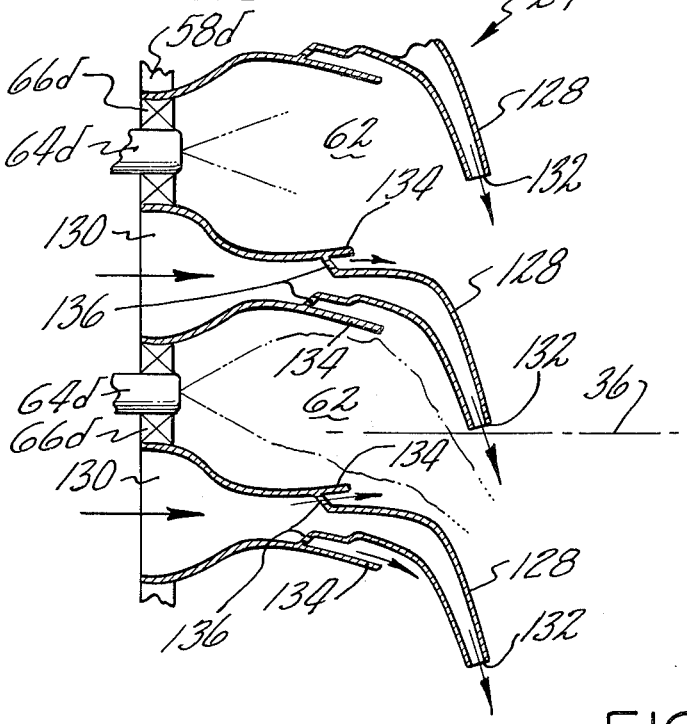

A fourth modification of combustion chamber 24 is shown in FIGS. 12 and 13, wherein radially extending forward wall 58*d* supports circumferentially oriented and spaced and axially extending fuel nozzles 64*d* and swirl flow rings 66*d* therewithin and further supports a plurality of circumferentially disposed and spaced deflection vane members 128. Vane or deflector members 128, shown in FIGS. 12 and 13, extend for the full radial dimension of pilot combustion zone 62, and are curved with respect to axial 36 as shown in FIG. 13 so as to cause the products of combustion from combustion zones 62 to be discharged in swirling fashion with respect to axis 36 so that they enter secondary fuel injection zone 110 in this swirling fashion. Deflector vanes 128 are hollow so that cooling air may enter the forward end 130 thereof and be discharged in swirling fashion about axis 36 through the outlet end 132 thereof. Preferably apertured cooling louvers 134 are located on opposite sides of deflector vanes 128 and have some of the cooling air from the vane interior discharged through apertures 136 in the side walls therethrough to cause cooling air to flow along the outer walls of vanes 128 to protect them from the heat of combustion.

Figure 15:
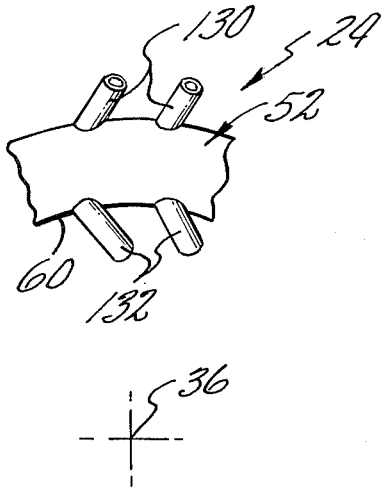
FIG. 15 is a view taken along line 15—15 of FIG. 14.
Figure 14:
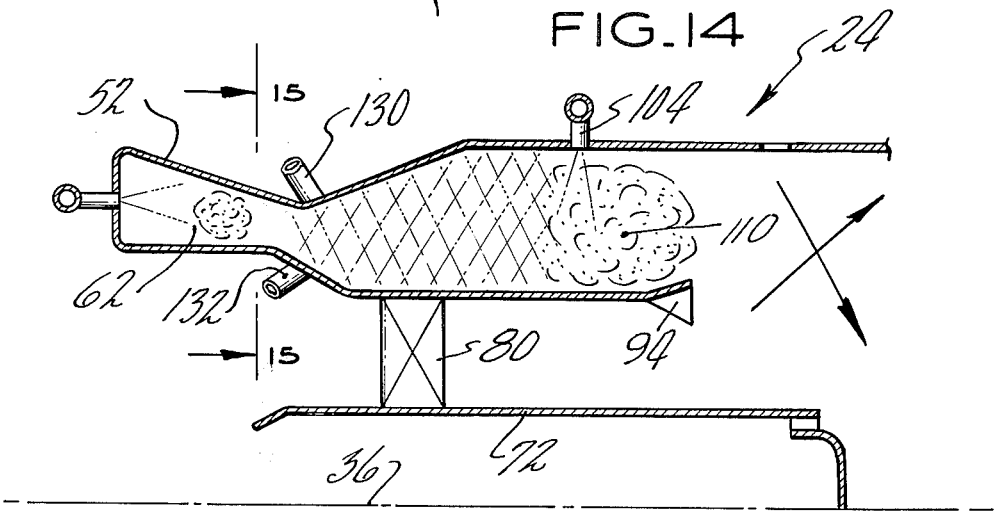
FIG. 14 is a cross-sectional showing of a modification of the combustion chamber utilizing canted plunger tubes to impart swirling flow to the pilot products of combustion as a substitute for the convoluted ring of FIG. 4.

Still another modification of combustion chamber 24 is shown in FIGS. 14 and 15. In this modification, combustion chamber 24 is intended to be in all respects like the combustion chamber shown in FIG. 4 except that the products of combustion from pilot combustion zone 62 are caused to swirl about combustion chamber axis 36 by positioning a plurality of circumferentially disposed and spaced plunged tubes 130 to project from the outer wall 52 of burner 24 and to be oriented so as to cause the air passing therethrough into the interior of the combustion chamber to be in a swirling motion about axis 36, to thereby impart a swirling motion to the products of combustion from the pilot combustion zone 62. Similarly, a plurality of circumferentially disposed plunged tubes 132 could be placed in inner wall 60 of the combustion chamber and be oriented as best shown in FIG. 15 to perform the same function. Obviously, in any combustion chamber outer tubes 130 could be used with or without inner tubes 132, and vice versa. Canted, plunged tubes 130 and 132 would serve the same function as does upstream swirler 92 in the FIG. 4 construction to impart a swirling motion to the pilot zone products of combustion about axis 36. It will be realized that when plunged tubes 130 and 132 are used in the same combustion chamber, they should be oriented to impart swirl to the products of combustion in the same direction about axis 36. Tubes 130 and 132 may be positioned in a radial alignment about axis 36 or may be circumferentially offset from each other.

We wish it to be understood that we do not desire to be limited to the exact details of construction shown and described, for obvious modifications will occur to a person skilled in the art.

We claim:

1. A low NOx combustion chamber comprising:

A. means to produce hot, fully combusted, pilot exhaust gases of reduced oxygen content, B. means to mix a selected quantity of cool, swirling air with the pilot exhaust gases to produce a first swirling mixture having a selected temperature lower than the pilot exhaust gases but above the vaporization temperature of the fuel to be utilized in the combustion chamber, and of reduced oxygen content so that the first swirling mixture has an ER less than 1,

C. means to inject atomized fuel into the first swirling mixture in selected quantity to produce a second swirling mixture of fuel and air of reduced oxygen content so that the second swirling mixture has a first ignition delay time to prevent autoignition of the atomized fuel droplets, said second swirling mixture also having a selected temperature to vaporize the fuel so that said second swirling mixture is a vaporized, swirling fuel-air mixture having a reduced oxygen content to produce autoignition at the culmination of the first time delay, and D. means to mix a selected quantity of swirling combustion air with the second swirling mixture to effect molecular mixing between the fuel and air since both the second mixture and combustion air are swirling, and in selected quantity to produce a third swirling, vaporized fuel-air mixture of oxygen level greater than that of said second mixture to effect a new and reduced ignition delay time so as to autoignite the third mixture at an ER less than 1 and at a time sooner than the expiration of the first ignition delay time to thereby reduce the dwell time of the engine air at NOx creating temperature.

2. A combustion chamber according to claim 1 having an axis and a pilot combustion chamber axially upstream of a main combustion chamber and wherein the first, second and third mixtures swirl concentrically about the axis.

3. A low NOx emission combustion chamber concentric about an axis and having a main combustion zone and including:

A. a pilot combustion chamber operable to produce vitiated products of combustion swirling about the axis and having a temperature hot enough to vaporize fuel, B. means for introducing fuel droplets into the swirling, products of combustion to rapidly mix therewith to produce a swirling, fully vaporized fuel-rich air mixture having selected oxygen content to establish a selected autoignition lag, and C. means to introduce swirling air to the swirling vaporized fuel-rich air mixture to produce accelerated mixing therebetween resulting in molecular premixing of the fuel and air and in sufficient quantity to reduce the ER to less than 1 and increase the oxygen content to accelerate autoignition to thereby produce high-rate, lean burning with resultant low NOx products of combustion.

4. A combustion chamber according to claim 2 wherein said pilot exhaust gas producing means includes said pilot combustion chamber including an annular chamber having a substantially radially extending forward wall with a plurality of fuel nozzles extending therethrough to inject fuel into the annular chamber and each having a swirl vane ring positioned thereabout so that the fuel nozzle and swirl ring extend axially and cooperate to effect stable combustion, and further including means to impart swirl to the vitiated products of combustion from pilot combustion chamber about the combustion chamber axis in the form of a first trigger mechanism comprising a corrugated ring whose convolutions are canted with respect to the axis and whose amplitudes increase in a downstream direction.

5. A combustion chamber according to claim 4 wherein the means for introducing swirling combustion air to the second vaporized, swirling fuel-air mixture is a second trigger mechanism in the form of a corrugated ring positioned concentric about the combustion chamber axis and having corrugations which are canted with respect to the axis and increasing in radial dimension in a downstream direction.

6. A combustion chamber according to claim 5 and including a passage having turning vanes therein and communicating with the first trigger mechanism to provide air thereto which has been acted upon by the turning vanes to cause swirling thereof about the combustion chamber axis.

7. A combustion chamber according to claim 6 and including passage means having turning vanes therein and communicating with the second trigger mechanism so that air passing therethrough is acted upon by said turning vanes to impart a swirl thereto concentric about the combustion chamber axis.

8. A combustion chamber according to claim 7 wherein the passages providing swirling air to the first and second trigger mechanisms are common in part and wherein a single set of turning vanes acts upon the air passing through each passage.

9. A combustion chamber according to claim 4 and wherein said triggers are axially spaced along the combustion chamber axis so that their effects in imparting swirl motion about the axis to the vaporized fuel-air mixture are additive.

10. A combustion chamber according to claim 9 wherein the corrugations in the triggers are canted with respect to the axis at selected angles so as to produce a 30° swirl about the axis to the vaporized fuel-air mixture departing the downstream trigger.

11. A combustion chamber according to claim 10 wherein the convolutions of each trigger are canted about 55 degrees to the axis.

12. A combustion chamber according to claim 7 wherein said triggers are axially spaced and concentric about the axis and with the downstream trigger communicating with the main combustion chamber zone, and with the triggers being sized and positioned so that the products of combustion from the pilot combustion zone will pass over the exterior corrugated surface of the upstream trigger and so that air passing through said passage will pass over the inner corrugated surface of said upstream trigger to have swirl imparted thereto to produce a product parameter $\rho V_t^2$ of passage air, wherein $\rho$ is density of passage air and $V_t$ is tangential velocity of passage air about the axis, which is greater than the corresponding product parameter of the pilot combustion chamber products of combustion, and wherein the second vaporized fuel-air mixture passes over the exterior corrugated surface of the downstream trigger while the air passing through said passage means passes over the inner corrugated surface of the downstream trigger so that the said product parameter of the passage means air passing over the downstream trigger has swirl imparted thereto so as to have a product parameter $\rho V_t^2$ greater than said product parameter of the second vaporized fuel-air mixture in view of the swirl imparted thereto by the downstream trigger.

13. A combustion chamber according to claim 9 wherein said combustion chamber has an outer wall having a plurality of circumferentially dispersed and spaced plunger holes extending therethrough in selected position to produce a series of radially directed combustion airstreams positioned to intercept the third swirling vaporized fuel-air mixture shortly after it passes over the downstream trigger.

14. A combustion chamber according to claim 5 and including means to impart dilution air to the combustion chamber interior to dilute and reduce the temperature of the main combustion chamber products of combustion.

15. A combustion chamber according to claim 3 and including a plurality of circumferentially spaced and disposed tube members connected to the inner or outer walls of the pilot combustion chamber, or both, and oriented at an angle to the combustion chamber axis so that air entering the pilot combustion chamber therethrough will be directed at a substantial angle with respect to the axis and thereby impart a rotary motion to the pilot combustion chamber products of combustion about the combustion chamber axis.

16. A combustion chamber concentric about an axis and having outer wall means and inner wall means supported in spaced relation to define an annular combustion chamber cavity therebetween and wherein said outer wall means and inner wall means are shaped so as to define:

A. an annular pilot combustion zone positioned at the combustion chamber forward end, B. trigger means in the form of a corrugated ring having corrugations canted with respect to the axis and increasing an amplitude in a downstream direction and positioned at the downstream end of the pilot combustion zone to impart swirl about the axis to the pilot zone products of combustion, C. an annular primary combustion zone located downstream of said pilot trigger and shaped to increase in cross-sectional area in a downstream direction so as to be in the form of a diffuser, D. a primary combustion zone trigger mechanism in the form of a corrugated ring mounted concentrically about the axis and having corrugations canted with respect to the axis and increasing in amplitude in a downstream direction and supported to be located at the entrance of the primary combustion zone and spaced axially downstream from the pilot trigger so that the pilot zone products of combustion will pass over the convolutions of both triggers, E. means to pass selected quantities of combustion air over the opposite corrugation surfaces of both triggers to produce accelerated mixing between the fluids passed over opposite surfaces of the triggers, F. means to introduce fuel droplets into the combustion chamber and circumferentially thereabout at an axial station between said triggers, and G. means to provide dilution air to the interior of the combustion chamber downstream of the primary combustion zone.

17. A combustion chamber according to claim 16 wherein the convolutions of said triggers are canted with respect to the axis selectively so as to produce about a 30° swirl motion about the axis of the fluid passing through the primary combustion zone.

18. A combustion chamber according to claim 17 wherein said trigger convolutions are canted with respect to the axis at an angle of about 55°.

19. A combustion chamber according to claim 16 and including a plurality of circumferentially spaced and dispersed plunger holes extending through the combustion chamber outer wall at an axial station slightly downstream of the primary combustion zone trigger and shaped to produce a series of radially directed airstreams into the primary combustion zone at a station immediately downstream of the combustion zone trigger.

20. A combustion chamber according to claim 16 and including flow turning means positioned upstream of said triggers and operably connected thereto and shaped so that the air passing thereover in passage to said triggers is caused to swirl about said axis.

21. A combustion chamber according to claim 16 and including a plurality of circumferentially spaced and disposed tube members connected to the inner and outer walls of the pilot combustion chamber, or both, and oriented at an angle to the combustion chamber axis so that air entering the pilot combustion chamber therethrough will be directed at a substantial angle with respect to the axis and thereby impart a rotary motion to the pilot combustion chamber products of combustion about the combustion chamber axis.

22. The method of producing low NOx combustion in a combustion chamber comprising the steps of:

A. producing hot, fully combusted, pilot exhaust gases of reduced oxygen content, B. mixing a selected quantity of cool, swirling air with the pilot exhaust gases to produce a first swirling mixture having selected temperature lower than the pilot exhaust gases but above the vaporization temperature of the fuel to be utilized in the combustion chamber, and of reduced oxygen content so that the first swirling mixture has an ER less than one, C. injecting atomized fuel into the first swirling mixture in selected quantity to produce a second swirling mixture of fuel and air of reduced oxygen content so that the second swirling mixture has a first ignition delay time to prevent autoignition of the atomized fuel droplets, said second swirling mixture also having a selected temperature to vaporize the fuel so that said second swirling mixture is a vaporized, swirling fuel-air mixture having a reduced oxygen content to produce autoignition at the culmination of the first time delay, and D. mixing a selected quantity of swirling combustion air with the second swirling mixture to effect molecular mixing between the fuel and air since both the second mixture and combustion air are swirling, and in selected quantity to produce a third swirling, vaporized fuel-air mixture of oxygen level greater than that of said second mixture to effect a new and reduced ignition delay time so as to autoignite the third mixture at an ER less than one and at a time sooner than the expiration of the first ignition delay time to thereby reduce the dwell time of the engine air at NOx creating temperature.

23. The method of producing combustion in a combustion chamber with low NOx emission comprising the steps of:

A. producing hot, vitiated products of combustion in a pilot burner,

B. cooling the pilot products of combustion to a temperature where they will vaporize selected fuel but retain their vitiated condition and causing them to swirl about an axis, C. introducing fuel in droplet form into the swirling, vitiated, cooled pilot products of combustion to produce flash vaporization of the fuel due to the high relative velocity between the fuel droplets and the swirling, vitiated products of combustion and due to the centrifugal force existing between the vitiated products of combustion and the fuel droplets so injected so as to produce a swirling, fully vaporized, fuel-air mixture having an oxygen content to establish a selected time delay to autoignition, D. introducing swirling combustion air to said vaporized, swirling fuel-air mixture to establish molecular premixing of the fuel and air and increase the oxygen content thereof to reduce the time lag and cause autoignition at an ER less than unity to thereby produce high-rate, lean burning of said premixed mixture so as to effect low NOx emission due to a combination of minimum dwell time of air above the NOx forming temperature and the high-rate, lean burning due to molecular premixing.

24. A method according to claim 23 wherein said vaporized, fuel-air mixture and said combustion air are swirling concentrically about the combustion chamber axis.

25. The method according to claim 22 and including the additional step of introducing a plurality of discrete streams of combustion air into the second swirling, vaporized fuel-air mixture in addition to said swirling combustion air to cooperate with said swirling combustion air in rapidly mixing with said swirling vaporized fuel-air mixture.

* * * * *